US005904254A

United States Patent [19]

Tinsley et al.

[11] Patent Number: 5,904,254

[45] **Date of Patent: *May 18, 1999**

[54] VIBRATORY PARTICLE SEPARATING APPARATUS

[75] Inventors: Travis M. Tinsley, Homer; Douglas M. Tinsley, Haynesville, both of La.; Gary G. Gathright, Hope, Ark.; Christofer B. Blank, Monroe, La.; Justin R. Price, Camby, Oreg.; Lorina J. White, Morganfield, Ky.; Philip E. Begley, Lincolnton, Ga.

[73] Assignee: Tinsley, Inc., Homer, La.

[ * ] Notice: This patent issued on a continued prosecution application filed under 37 CFR 1.53(d), and is subject to the twenty year patent term provisions of 35 U.S.C. 154(a)(2).

[21] Appl. No.: 08/670,782

[22] Filed: Jun. 20, 1996

[51] Int. Cl.[6] ..... B07B 1/28

[52] U.S. Cl. ..... 209/314; 209/399; 209/405

[58] Field of Search ..... 209/243, 254, 209/309, 311, 314, 397, 399, 405, 409, 412

[56] References Cited

U.S. PATENT DOCUMENTS

| | | | |
|---|---|---|---|
| 89,589 | 5/1869 | McLane | 209/314 |
| 138,408 | 4/1873 | Jones | 209/314 X |
| 238,800 | 3/1881 | Morris | 209/32 |
| 2,703,649 | 3/1955 | Cheyette | 209/394 X |
| 2,775,347 | 12/1956 | Weston | 209/314 |
| 4,624,370 | 11/1986 | Danner | 209/631 |
| 4,802,591 | 2/1989 | Lower | 209/680 |
| 4,844,235 | 7/1989 | Sherman | 198/688.1 |
| 4,962,896 | 10/1990 | Robinson | 241/266 |
| 5,054,606 | 10/1991 | Musschoot | 198/751 |
| 5,064,053 | 11/1991 | Baker | 198/753 |
| 5,085,324 | 2/1992 | Dehlen | 209/405 X |
| 5,108,589 | 4/1992 | Sherman | 209/660 |
| 5,123,516 | 6/1992 | Moore | 198/396 |
| 5,368,167 | 11/1994 | Howes | 209/395 |
| 5,417,858 | 5/1995 | Derrick | 210/388 |

FOREIGN PATENT DOCUMENTS

| | | | |
|---|---|---|---|
| 719703 | 3/1977 | Russian Federation . | |
| 988368 | 6/1983 | Russian Federation . | |
| 988368 | 1/1983 | U.S.S.R. | 209/314 |

OTHER PUBLICATIONS

Hendrick Flanged Lip Granular Material Screen Catalog with Screen Specification—Carbondale, Penn., 1948.

*Primary Examiner*—Tuan N. Nguyen
*Attorney, Agent, or Firm*—John M. Harrison

[57] ABSTRACT

A vibratory particle separating apparatus for separating a supply of particulate material into two streams according to particle size. The apparatus includes an inclined particle separating screen secured in a mount frame and characterized by multiple steps disposed perpendicular to the path of material flow. The mount frame is suspended in a support frame by resilient float mounts and vibrated by a vibratory motor mounted on the mount frame. The particulate material is loaded on the top inclined end of the vibrating screen and as the material cascades down the steps of the screen, particles smaller than a selected size fall through one of multiple, adjacent openings provided in each step and are collected or discharged for further processing in a stream below the screen, whereas larger particles are collected or discharged in a separate stream at the foot of the screen. In another embodiment the float mounts can be adjusted to vary the vibratory motion of the screen and thereby optimize particle separation according to the characteristics of the material. In still another embodiment the openings are omitted from a step or steps in the top inclined end of the screen, such that elongated particles such as sticks being loaded on the screen must lie flat and slide down to the foot of the screen instead of sliding through the openings and mixing with the smaller particles being separated from the material.

15 Claims, 3 Drawing Sheets

VIBRATORY PARTICLE SEPARATING APPARATUS

BACKGROUND OF THE INVENTION

1. Field of the Invention

This invention relates to devices for separating particles of different sizes in a supply of particulate material and more particularly, to a vibratory particle separating apparatus for separating a supply of particulate material such as wood chips, shredded tire particles and the like, into two streams according to particle size. In a preferred embodiment, the apparatus is characterized by a particle separating screen including multiple steps shaped perpendicular to the path of material flow and mounted in sloped configuration in a mount frame. The mount frame is suspended in a support frame by resilient rubber or plastic float mounts and vibrated by a vibratory motor mounted on the mount frame. As the supply of material is loaded on the top inclined end of the vibrating screen, the material cascades down the steps of the screen and particles smaller than a selected size fall through one of multiple, adjacent openings provided in each step and are collected or discharged for further processing in a stream below the screen, whereas particles too large to fall through the opening are collected or discharged in a separate stream at the foot of the screen. In one embodiment the vibratory motion of the screen may be varied to optimize particle separation according to the characteristics of the material, by adjusting the angle of the float mounts with respect to the support frame. In another embodiment the openings in the upper step or steps on the top inclined end of the particle separating screen are omitted, or "blinded", such that elongated particles such as sticks being loaded on the screen must lie flat and slide down to the foot of the screen, instead of "diving" through one of the openings and mixing with the smaller particles being separated from the material.

Many devices are known for separating particles according to size in a stream of particulate material containing wood waste, shredded tires and the like. For example, in separation of particles in a wood waste stream, these devices are used to separate the "fines", or particles smaller than a desired size, from the "overs", or particles larger than the desired size. The "fines" are typically removed from the stream in order to reduce wear on downstream equipment which processes or sizes the larger particles, as well as to facilitate alternative processing of the material, such as drying, grit removal or by-pass of redundant sizing.

Most particle separating devices utilize a screen having an arrangement of openings, through which the "fines" may pass but the "overs" may not. After falling through the openings, the "fines" are collected or discharged for further processing in one stream, whereas the "overs" are collected or discharged from the end of the screen in a separate stream. In some instances, some of the openings have a tendency to "blind" or become plugged with particles having a size between that of the "fines" and that of the "overs". The new and improved design of this invention prevents "blinding" of the openings by the shape and orientation of the openings in the surface of the particle separating screen, such that particles having a tendency to plug the openings are either vibrated out of the openings or pushed out of the openings by the oncoming stream of material and continue sliding down to the foot of the screen.

2. Description of the Prior Art

Several devices are known in the art for separating particles in a mixture of particulate material according to particle size, weight or other characteristics. U.S. Pat. No. 4,624,370, dated Nov. 25, 1986, to Gary A. Danner, describes a "Vibratory Separation Apparatus" having upper and lower conveying surfaces separated by an opening. A mixture of particulate material is conveyed by a vibrating action beyond the upper conveying surface and through the opening. A stream of air is directed from below the upper conveying surface against the falling particles and propels particles having a predetermined density or dimension onto the lower conveying surface. U.S. Pat. No. 4,802,591, dated Feb. 7, 1989, to William E. Lower, et al, discloses a "Louvered Chip Screener" for separating chip-shaped particles according to thickness. The screener is characterized by a sloping deck having a series of spaced, flexible slats which extend parallel to the direction of chip flow. The deck is subjected to a horizontal gyratory motion such that particles smaller than a selected size fall between the slats and are collected or discharged in one stream, whereas larger particles slide down the slats and are collected or discharged at the foot of the deck. A "Vibratory Separation Apparatus" is detailed in U.S. Pat. No. 4,844,235, dated Jul. 4, 1989, to Raymond W. Sherman, in which apparatus a resilient liner is provided on the particle supporting surfaces of a vibratory conveyor system. The liner provides a surface which prevents the particles from adhering to each other and to the conveying surface and is particularly effective when used in particle separating systems. U.S. Pat. No. 5,108,589, dated Apr. 28, 1992, to Raymond W. Sherman, discloses a "Material Separating Apparatus" for separating particles of different sizes. The apparatus includes a trough having a material input end and a material discharge end, and a screen having multiple, longitudinally-spaced finger screen sections extends over the trough. As the trough is vibrated, particles smaller than a preselected size pass through the fingers, whereas larger particles move from the input end to the discharge end of the trough. A "Vibrating Conveyor Screening Method and Apparatus" for screening fine particles from a stream of particulate material, is detailed in U.S. Pat. No. 5,368,167, dated Nov. 29, 1994, to Glen E. Howes. The apparatus is characterized by first and second sets of transversely-spaced, longitudinally-extending members disposed parallel to each other. At least one of the sets is mounted to vibrate along a longitudinal axis to feed material therealong. Multiple, spaced, transversely-extending third members are located between the first and second members defining multiple screen openings between the first, second and third members. As the particulate material is passed over the apparatus, the fine particles fall through the screen openings, whereas larger particles are discharged from the end of the apparatus. A "Screen Assembly For Vibrating Screening Machine" is disclosed in U.S. Pat. No. 5,417,858, dated May 23, 1995, to William W. Derrick, et al. The screen assembly is characterized by a plate having spaced apertures and channels formed in the sides for attachment to a vibratory screening machine. Spaced frame members are provided on opposite sides of the plate and an undulating screen is mounted between the frame members above the plate. The screen includes substantially parallel ridges with downwardly-sloping sides and troughs formed between the sides for conducting the material.

An object of this invention is to provide a vibratory particle separating apparatus for separating particulate material according to particle size.

Another object of this invention is to provide a vibratory particle separating apparatus characterized by a sloped particle separating screen which vibrates responsive to operation of a vibratory motor and receives a supply of particulate material, wherein the material cascades down the vibrating screen and particles smaller than a selected size fall through openings provided in the screen and are collected or discharged below the screen and particles larger than the selected size are collected or discharged for further processing at the foot of the screen.

Still another object of this invention is to provide a vibratory particle separating apparatus for receiving and separating a supply of particulate material into two streams according to particle size, which apparatus is characterized by a vibrating particle separating screen mounted in a frame in sloped configuration and shaped in a series of steps from the top inclined end of the screen to the foot of the screen, wherein particles of a selected size fall through one of multiple openings in the steps and are collected or discharged in one stream and particles larger than the selected size cascade to the bottom end or foot of the screen and are collected or discharged in a separate stream.

Yet another object of this invention is to provide a vibratory particle separating apparatus characterized by a sloped particle separating screen including multiple steps formed therein and multiple openings included in the steps wherein particles having a tendency to plug the openings are either vibrated out of the openings or pushed out of the openings by the oncoming stream of material.

SUMMARY OF THE INVENTION

These and other objects of the invention are provided in a vibratory particle separating apparatus for separating a stream of particulate material into two streams according to particle size. The apparatus includes an inclined or sloped particle separating screen mounted in a mount frame and including multiple steps shaped in the screen, with a series of adjacent openings provided in each step. The mount frame is resiliently mounted in a support frame by means of resilient rubber or plastic float mounts and includes a vibratory motor for vibrating the particle separating screen. The particulate material is loaded on the top inclined end of the top vibrating screen and as the material cascades down the steps of the screen, particles smaller than a selected size fall through the openings and are collected or discharged in one stream for further processing, whereas larger particles are collected or discharged in another stream at the foot of the screen. In another embodiment the resilient float mounts can be selectively positioned to optimize the vibratory motion of the screen for optimum separation of the material. In still another embodiment, a step or steps on the inclined end of the screen are omitted, or "blinded", such that sticks or other elongated particles loaded on the screen cannot fall or "dive" through one of the openings and mix with the smaller particles being separated from the material, but instead must lie flat and slide down to the foot of the screen.

BRIEF DESCRIPTION OF THE DRAWINGS

The invention will be better understood by reference to the accompanying drawings, wherein.

DESCRIPTION OF THE PREFERRED EMBODIMENTS

Figure 4:
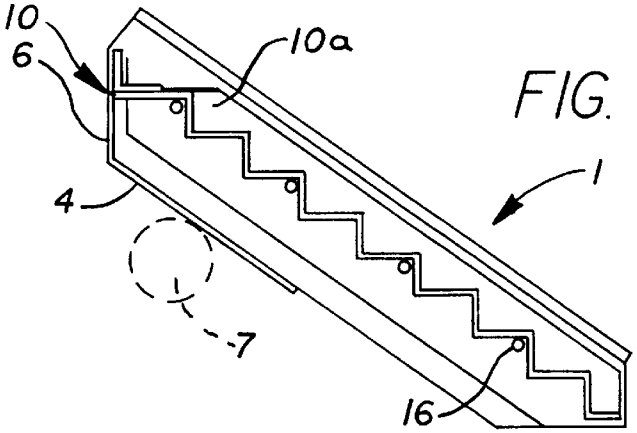
FIG. 4 is a side sectional view of the mount frame and particle separating screen elements illustrated in FIG. 3.
Figure 2:
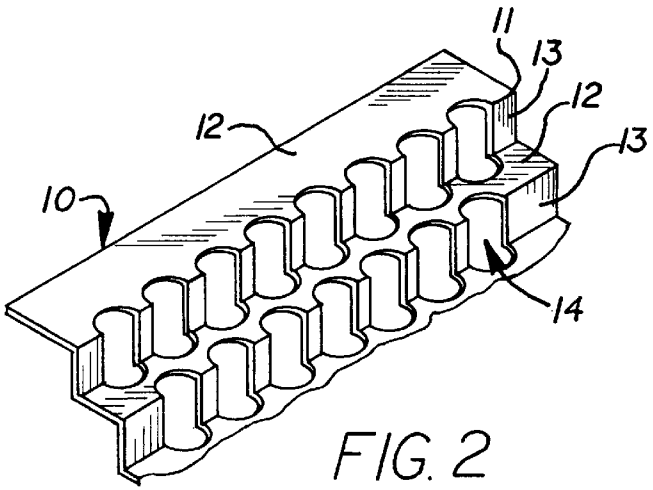
FIG. 2 is a perspective view, of the particle separating screen illustrated in FIG. 1, shaped into a step configuration.
Figure 1A:
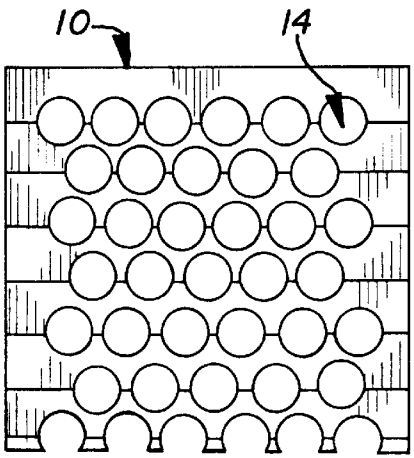
FIG. 1A is a top view of the particle separating screen illustrated in FIG. 1, shaped into a step configuration.
Figure 1:
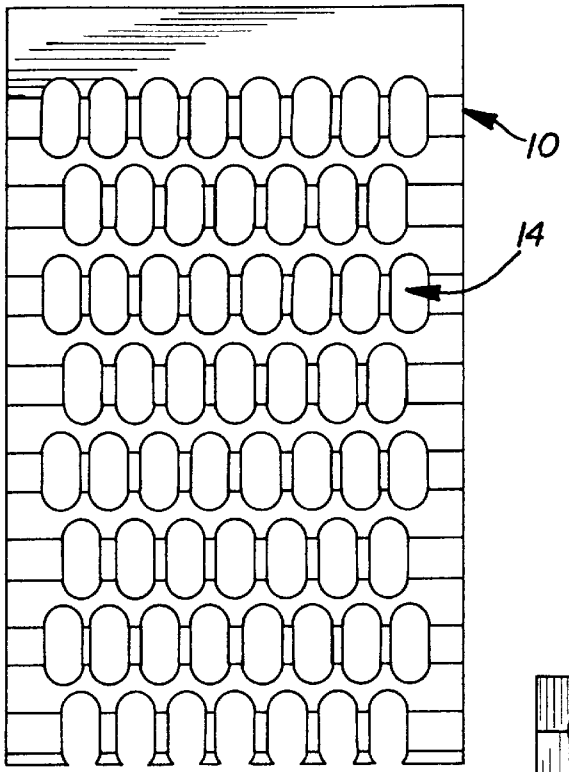
FIG. 1 is a top view of a preferred embodiment of the particle separating screen of the vibratory particle separating apparatus of this invention.
Figure 3:
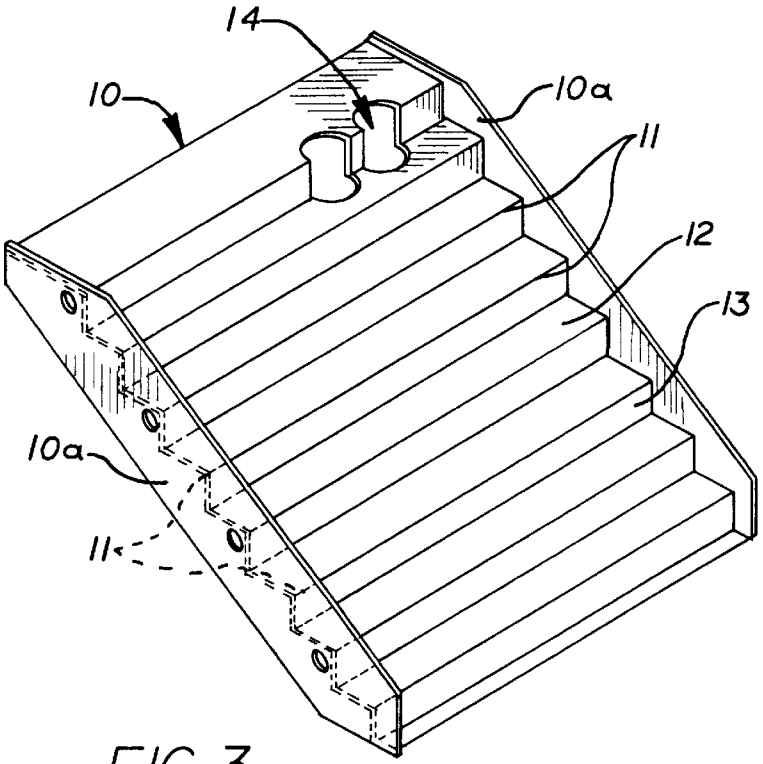
FIG. 3 is a perspective view of the mount frame and particle separating screen elements.
Figure 10:
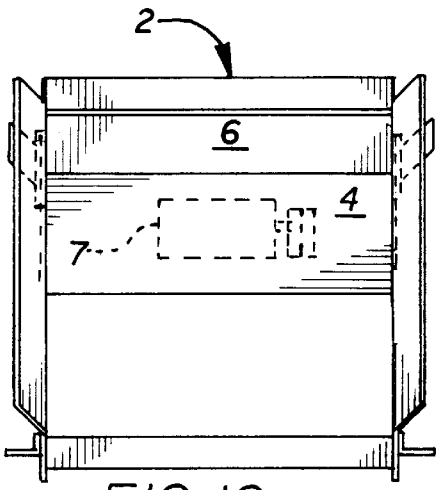
FIG. 10 is a front view of the mount frame illustrated in FIG. 9.
Figure 11:
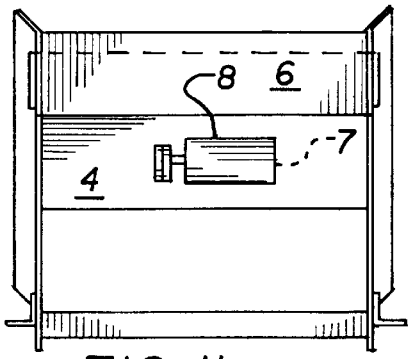
FIG. 11 is a rear view of the mount frame.
Figure 9:
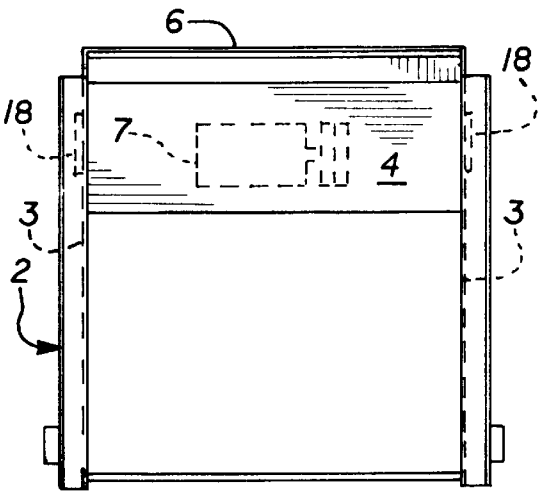
FIG. 9 is a top view of the mount frame that seats in the support frame of the vibratory particle separating apparatus.

Referring initially to FIGS. 1–4 of the drawings, in a preferred embodiment the vibratory particle separating apparatus, hereinafter referred to as the apparatus, of this invention is generally illustrated by reference numeral 1. The apparatus 1 includes a mount frame 2 characterized by a pair of spaced side panels 3, connected by a front panel 5, a sloped motor panel 4 (illustrated in FIG. 5) and a rear panel 6. As illustrated in FIGS. 1–3, a particle separating screen 10, typically constructed from a flat steel sheet (FIG. 1), includes multiple screen steps 11 folded therein, (FIGS. 1A, 2 and 3), each screen step 11 having a horizontal surface 12 and a vertical surface 13, as illustrated in FIG. 3. A series of multiple, adjacent screen openings 14, each having a selected size are formed in adjacent screen steps 11, with each screen opening 14 formed in the horizontal surface 12 and vertical surface 13 of one screen step 11 and the horizontal surface 12 of the adjacently underlying screen step 11, as illustrated in FIG. 3. As further illustrated in FIG. 3, the screen openings 14 in one series of screen openings 14, are typically offset with respect to the screen openings 14 in an adjacent series. A pair of screen sides 10*a* (illustrated in FIG. 3) are shaped along the lateral edges of or welded to the particle separating screen 10 and extend above and below the plane of the particle separating screen 10. As illustrated in FIGS. 3 and 4, the particle separating screen 10 is secured in the mount frame 2 in sloped configuration, by means of multiple, headed bolts 16 which extend through each screen side 10*a* and the side panel 3 of the mount frame 2, and each threadably receive a nut 17. As illustrated in FIG. 11, an electric, eccentric-shaft vibratory motor 7 is mounted on the outside surface of the motor panel 4, by means of motor mounts 8. A closed-ended float mount clevis 19 is fixedly mounted in each side panel 3 of the mount frame 2, below the front edge of the particle separating screen 10 for resting on a resilient float mount 18, mounted on a support frame 20 (illustrated in FIG. 8), as hereinafter further described.

Figure 5:
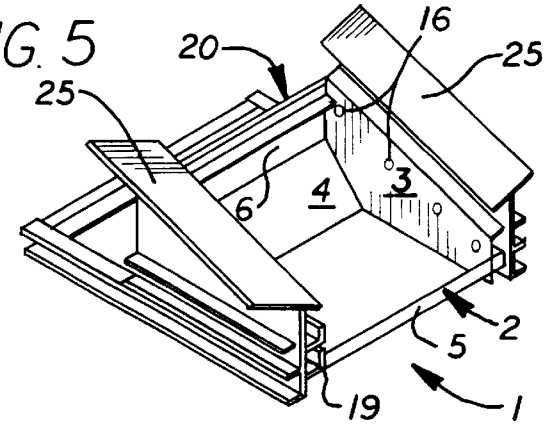
FIG. 5 is a perspective view of the vibratory particle separating apparatus, with the support frame ready to receive the particle separating screen.
Figure 7:
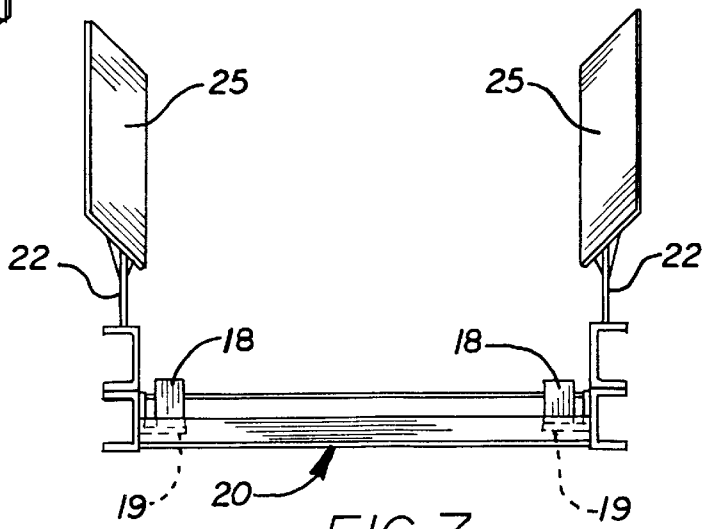
FIG. 7 is a front view of the support frame.
Figure 8:
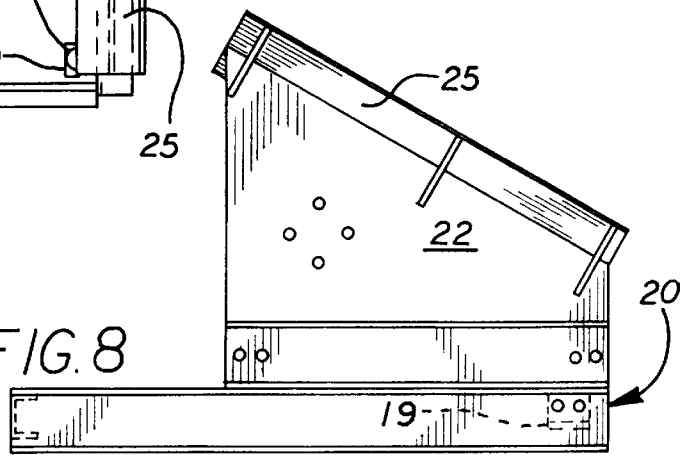
FIG. 8 is a right side view of the support frame.
Figure 6:
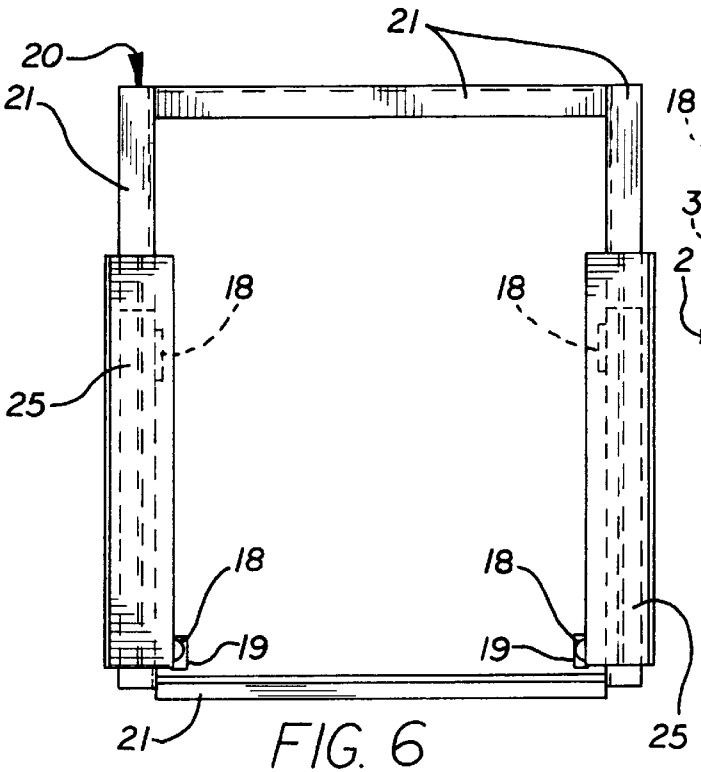
FIG. 6 is a top view of the support frame of the vibratory particle separating apparatus illustrated in FIG. 5.

Referring next to FIGS. 7 and 8 of the drawings, the mount frame 2 and attached particle separating screen 10 are resiliently mounted in a support frame 20, characterized by a rectangular base 21 having a pair of side walls 22 extending upwardly from the lateral sides of the base 21 and connected by a rear wall 23. As illustrated in FIG. 8, a closed-ended float mount clevis 19 is fixedly mounted in each side of the base 21, adjacent to the front end thereof and a resilient float mount 18, typically constructed from rubber or resilient plastic, is bolted or otherwise attached between the float mount clevis 19 provided in the mount frame 2 and float mount clevis 19 provided in the base 21 of the support frame 20. An additional float mount 18 is interposed in like manner between each side panel 3 of the mount frame 2 and adjacent side wall 22 of the support frame 20, as illustrated in phantom in FIG. 6. The mount frame 2 is thus resiliently mounted or seated in the support frame 20, as illustrated in FIG. 5, to accommodate vibratory motion of the mount frame 2 and particle separating screen 10 with respect to the support frame 20 responsive to operation of the vibratory motor 7. In another embodiment (not illustrated), the float mount clevis 19 are pivotally mounted in the mount frame 2 and support frame 20, respectively. By pivoting each float mount clevis 19 and interposed float mount 18 with respect to the plane of the particle separating screen 10, the vibratory motion of the particle separating screen 10 may be varied, as desired, to optimize separation, according to the characteristics of the material. As illustrated in FIG. 7, in a most preferred aspect of a preferred embodiment particle deflectors 25 are welded or otherwise attached to the side walls 22 of the support frame 20, to prevent particulate material being separated on the particle separating screen 10 from falling over the sides of the support frame 20.

Referring again to FIGS. 2–4 of the drawings, in operation the vibratory particle separating apparatus 1 is used for separating a supply of particulate solid material (not illustrated) such as dirt, bark, wood, rubber, metal, plastic and the like, into separate streams according to particle size. The vibratory motor 7 is first energized to vibrate the mount frame 2 and attached particle separating screen 10. The material is then poured on the particle separating screen 10, adjacent to the inclined rear edge thereof. As the particle separating screen 10 vibrates, the material cascades down the screen steps 11 toward the bottom front edge or foot of the particle separating screen 10. Particles smaller than the screen openings 14 fall through the screen openings 14 and are collected in a receptacle (not illustrated) or diverted by means of chutes (also not illustrated) for further processing. The particles too large to fall through the screen openings 14, cascade down the screen steps 11 to the foot of the particle separating screen 10 and are likewise either collected or diverted for further processing. Particles which tend to clog or "blind" the screen openings 14 are either vibrated or pushed out of the screen openings 14 by the oncoming stream of material, and cascade down to the foot of the particle separating screen 10.

Referring next to FIG. 5 of the drawings, it is understood that the screen openings 14 may be omitted from any number of screen steps 11 in the particle separating screen 10. For example, the screen openings 14 may be omitted from the first one, two or three screen steps 11 located at the inclined end of the screen 10. As the material is loaded on these screen steps 11 of the vibrating particle separating screen 10, sticks and other elongated particles are caused to lie flat on the particle separating screen 10 and slide to the foot of the screen 10, and are thus prevented from "diving" or falling lengthwise through the screen openings 14 and mixing with the small particles being separated from the material.

It will be understood that in a preferred embodiment of the invention the vibratory motor 7 imparts a circular or elliptical motion to a selected area of the particle separating screen to which it is attached. Accordingly, other areas of the particle separating screen may be subjected to translative or rotary motion depending upon the design choice of the float mounts 18.

While the preferred embodiments of the invention have been described above, it will be recognized and understood that various modifications may be made in the invention and the appended claims are intended to cover all such modifications that fall within the scope and spirit of the invention.

Having described my invention with the particularity set forth above, what is claimed is:

1. A vibratory particle separating apparatus for separating particles smaller than a selected size from larger particles in a supply of particulate material, comprising:

a support frame;

screen means resiliently mounted in said support frame in sloped configuration for vibration in said support frame, said screen means having:

an inclined input end for receiving the particulate material, a discharge end spaced from said input end, a plurality of steps transversely folded in said screen means to define a substantially horizontal step element and a substantially vertical step element joining said horizontal step element in each of said steps, said steps being disposed between said inpurt end, and said discharge end and at least one opening having a selected size and substantially uniform width, each said at least one opening being disposed in a horizontal step element and a vertical step element of a first step and a contiguous horizontal step element of a second step, wherein each said opening extends a substantially equal distance into said horizontal step element of said first step and said horizontal step element of said second step, and wherein said second step is disposed between said first step and said discharge end; and vibrating means for vibrating said screen means in said support frame, whereby the particulate material cascades down said steps, the particles smaller than the selected size fall through said at least one opening and the larger particles are discharged at said discharge end of said screen means, responsive to operation of said vibrating means.

2. The apparatus of claim 1 wherein said at least one opening comprises a plurality of openings.

3. The apparatus of claim 1 wherein said screen means comprises a mount frame and a particle separating screen mounted in said mount frame and said mount frame is resiliently mounted in said support frame.

4. The apparatus of claim 3 wherein said at least one opening comprises a plurality of openings.

5. The apparatus of claim 3 wherein said vibrating means comprises a vibratory motor mounted on said mount frame.

6. The apparatus of claim 5 wherein said at least one opening comprises a plurality of openings.

7. The apparatus of claim 5 wherein said at least one step comprises a plurality of steps and said at least one opening comprises a plurality of openings.

8. A vibratory particle separating apparatus for separating a supply of particulate material into a first stream having particles smaller than a selected size and a second stream having larger particles, said vibratory particle separating apparatus comprising:

a support frame;

a mount frame resiliently mounted in said support frame; and an elongated particle separating screen bolted in said mount frame in sloped configuration, said particle separating screen comprising:

an inclined input end for receiving the particulate material, a discharge end longitudinally spaced from said input end, at least two steps transversely folded in said particle separating screen from said input end to said discharge end, said steps having a substantially vertical surface and a substantially horizontal surface joining said vertical surface, at least one opening having a selected size and a substantially uniform width arranged in a selected pattern in at least one of said steps, said opening being common to and substantially equal in length to adjacent ones of said horizontal surface and said vertical surface; and a vibratory motor mounted on said mount frame for vibrating said mount frame in said support frame, whereby the particulate material cascades down said steps, the particles smaller than the selected size fall through said at least one opening and are discharged in the first stream and the larger particles are discharged at said discharge end of said particle separating screen in the second stream, responsive to operation of said vibratory motor.

9. The apparatus of claim 8 wherein said at least one opening comprises a plurality of openings.

10. The apparatus of claim 8 wherein at least one of said at least one opening is omitted from the first one of said steps located at said input end of said particle separating screen.

11. The apparatus of claim 8 wherein at least one of said at least one opening comprises a plurality of openings and said plurality of openings is omitted from the first one of said steps located at said input end of said particle separating screen.

12. The apparatus of claim 8 wherein at least one of said at least one opening is omitted from the first two of said steps located at said input end of said particle separating screen.

13. The apparatus of claim 12 wherein said at least one opening comprises a plurality of openings.

14. A vibratory particle separating apparatus for separating a supply of particulate material into a first stream having particles smaller than a selected size and a second stream having larger particles, said vibratory particle separating apparatus comprising:

a support frame;

a mount frame resiliently mounted in said support frame; and an elongated particle separating screen bolted in said mount frame in sloped configuration, said particle separating screen comprising;

an inclined input end for receiving the particulate material, a discharge end longitudinally spaced from said input end;

a plurality of steps transversely folded in said particle separating screen from said input end to said discharge end, wherein the first one of said steps is located at said input end; and a plurality of openings having a selected size and substantially uniform width, each of said openings being disposed in said horizontal surface and said vertical surface of a first step and a contiguous horizontal surface of a second step, wherein each of said openings extends a substantially equal distance into said horizontal surface of said first step and said horizontal surface of said second step; and a vibratory motor mounted on said mount frame for rotatably vibrating at least a portion of said mount frame in said support frame, whereby the particulate material cascades down said steps, the particles smaller than the selected size fall through said plurality of openings and are discharged in the first stream and the larger particles are discharged at said discharge end of said particle separating screen in the second stream, responsive to operation of said vibratory motor.

15. The apparatus of claim 14 wherein at least one of said plurality of openings is omitted from the first three of said steps located at said input end of said particle separating screen.

* * * * *